US008852032B1

(12) United States Patent
Barnes

(10) Patent No.: US 8,852,032 B1
(45) Date of Patent: Oct. 7, 2014

(54) BAT SWING TRAINING MACHINE

(76) Inventor: Jerry Barnes, Santa Ana, CA (US)

( * ) Notice: Subject to any disclaimer, the term of this patent is extended or adjusted under 35 U.S.C. 154(b) by 222 days.

(21) Appl. No.: 13/491,540

(22) Filed: Jun. 7, 2012

(51) Int. Cl.
*A63B 69/00* (2006.01)

(52) U.S. Cl.
CPC ..... *A63B 69/00* (2013.01)
USPC ..... 473/453

(58) Field of Classification Search
USPC ..... 473/209, 229, 453; 482/83, 94, 93, 7; 73/12.14; 267/155; 248/125.1, 188.5; 224/29.5; 211/189, 204; 16/76, 256
See application file for complete search history.

(56) References Cited

U.S. PATENT DOCUMENTS

| | | | | | |
|---|---|---|---|---|---|
| 189,153 | A * | 4/1877 | Towel et al. | ..... | 251/337 |
| 1,925,945 | A * | 9/1933 | Zielinski et al. | ..... | 16/76 |
| 2,273,791 | A * | 2/1942 | Wirgin | ..... | 248/188.5 |
| 2,306,797 | A * | 12/1942 | Biery | ..... | 182/201 |
| 2,605,097 | A * | 7/1952 | Masoner | ..... | 267/155 |
| 4,720,096 | A * | 1/1988 | Rogers | ..... | 482/106 |
| 4,921,245 | A * | 5/1990 | Roberts | ..... | 482/42 |
| 5,156,402 | A * | 10/1992 | Hart | ..... | 473/229 |
| 5,242,344 | A * | 9/1993 | Hundley | ..... | 482/93 |
| 5,390,915 | A * | 2/1995 | Levatino | ..... | 473/453 |
| 5,582,403 | A * | 12/1996 | George | ..... | 473/424 |
| D387,835 | S * | 12/1997 | Abram et al. | ..... | D21/791 |
| 2011/0294606 | A1* | 12/2011 | Llyod | ..... | 473/422 |

OTHER PUBLICATIONS

Webpage download, Amazon—TKO, 2006, www.amazon.com/TKO-Heavy-Bag-Wall-Mount/dp/B0007ZF4V8/, 1 page.*

Webpage download, XMarkAmazon, 2012, www.amazon.com/XMark-Adjustable-Heavy-Mount-XM-2846/dp/B004OP68JY/, 3 pages.*

* cited by examiner

*Primary Examiner* — Gene Kim
*Assistant Examiner* — M Chambers
(74) *Attorney, Agent, or Firm* — Plager Schack, LLP

(57) ABSTRACT

A bat swing training machine for improving a user's bat swing technique and developing muscular strength includes a frame carried by an adjustable post for height adjustment and two mounting brackets for installation in various locations. The machine also includes a torsion spring, a swing arm with swivel linkage and a bat handle. The machine provides torsional resistance with precise positional control throughout the swing motion and does so equally for right and left handed swings. Backswing is relatively un-resisted thereby allowing the athlete or trainee to stay in position and continuously repeat the swing motion.

10 Claims, 3 Drawing Sheets

BAT SWING TRAINING MACHINE

BACKGROUND OF THE INVENTION

Many types of batting training devices have been developed to help build an athlete's muscle groups to increase strength, bat speed, and stamina as well as improve technique for overall performance. While all of these aspects are necessary to increase an athlete's ability it is also important to recognize the differences and similarities in the swing motion of baseball, softball, tennis, golf; and hockey. They all require a swinging motion using implements such as bats, rackets, clubs or sticks to propel a ball or puck.

For purposes of describing and illustrating this invention, the discussion below will focus on baseball and softball and the athletes who wish to develop, practice and enhance their batting skills. However, this description and illustration is not intended to be limiting, and those familiar with the aforementioned sports and activities will recognize that the device described herein can be adapted to developing strength and coordination while swinging the appropriate implements in their respective sport or activity. Accordingly, any references herein to baseball, batting, batting practice, or other sporting activities are intended to be merely illustrative, and not limiting.

Any references to "practice" and "exercise" used herein are to describe the physical motion and activities necessary for the strengthening and coordination of various muscle groups. As an example batting practice using the machine disclosed herein will help develop and strengthen an athlete's core muscles in the abdomen and legs, as well as numerous muscles in the arms, shoulders, and chest. Core strength is defined by development of the muscles forming around the trunk of the body including the abdominal, oblique (sides), mid and lower back.

It is very important when practicing the swing motion to have precise positional control of the swing path throughout the swing motion. This control substantially increases the muscle memory and strength required for the legs and upper body to work in coordination while performing the entire swing motion correctly. In addition, performing repeated practice of the correct swing motion will substantially improve the performance of all levels of athletes. Although in most sports or activities the ball or puck is not always in the same position, causing the swing plane to change. This should not affect the swing motion of the core muscles of the athlete, only the plane at which the implement is swung.

In any such sport the implement being swung moves in a swing path that may not always be on the same plane, pivot point or axis. This path generally approximates a centrifugal arc necessary for the striking portion of the bat, racket, club or stick to strike the ball or puck with the desired contact point.

With regard to batting practice for baseball and softball players, there are three main categories of exercise and practice devices that have been developed. One category includes pitching machines and ball striking devices which focus on striking the ball with the bat. Pitching machines typically throw a ball somewhat consistently in a specific pathway for a batter to attempt to hit. Other ball striking devices consist of various types of "soft toss" machines which lob the ball into the hitting zone pathway, various types of tethered balls, and batting tees. Another category is unusually heavy bats and various designs of bat weights which have proven to be very beneficial for the batter while performing swing motions to loosen up or warm up their muscles. The obvious purpose of swinging a heavy or weighted bat is to give the batter the feeling that their own bat is much lighter in contrast so that the batter could have a faster swing or a "quick bat" as the term is used. The third category consists of various types of complicated cable-and-pulley systems which provide controlled resistive forces as to build a batters muscle groups and core strength.

As all of the aforementioned devices are useful, some of them are also necessary for use in common practice of batters to improve their performance. However, none of the devices currently available focus on resistance with precise positional control which is necessary for a batter to practice correct technique.

Throughout the history of sports, coaches and organizations have relied on generalized exercise that consists of calisthenics, running and free weight training to improve an athlete's abilities. All of these help to increase the strength and stamina of an athlete, but it is also essential to transfer these improvements to the sport of interest and to run through the fundamentals needed to play the game. Newer techniques of concurrent training have been used in an attempt to add resistance and/or inertia to the athletic activity that one is attempting to improve. An example of this type of training is used by sprinters attaching parachutes to their waists which provide resistance as they run. Similarly there are also elastic bands, weighted sleds and other devices including weighted vests and ankle weights.

SUMMARY OF THE INVENTION

The object of the invention is to provide a batting training device which provides variable resistance, is fully adjustable for all ages, and creates a swing path with precise positional control. In addition the training device is compact and can be mounted on a wall, fence post, or in a batting cage facility. Unlike large complicated pulley systems and weight machines it can be transported easily. The compact design of the batting training machine permits it to be used in various locations without compromising a great deal of practice space and safety. This would include batting cage facilities, sports parks, and home use.

It is therefore the objective of the invention to provide a new, improved and inexpensive sports training device that strengthens the athlete by using spring loaded, no impact resistance. Without having impact, the invention decreases the possibility of injury.

Another objective of the invention is to provide a safe method for each athlete to warm up and/or practice his swing without using his bat. It can be dangerous to swing a bat with other players around and can cause serious injury.

DETAILED DESCRIPTION OF THE INVENTION

Figure 1:
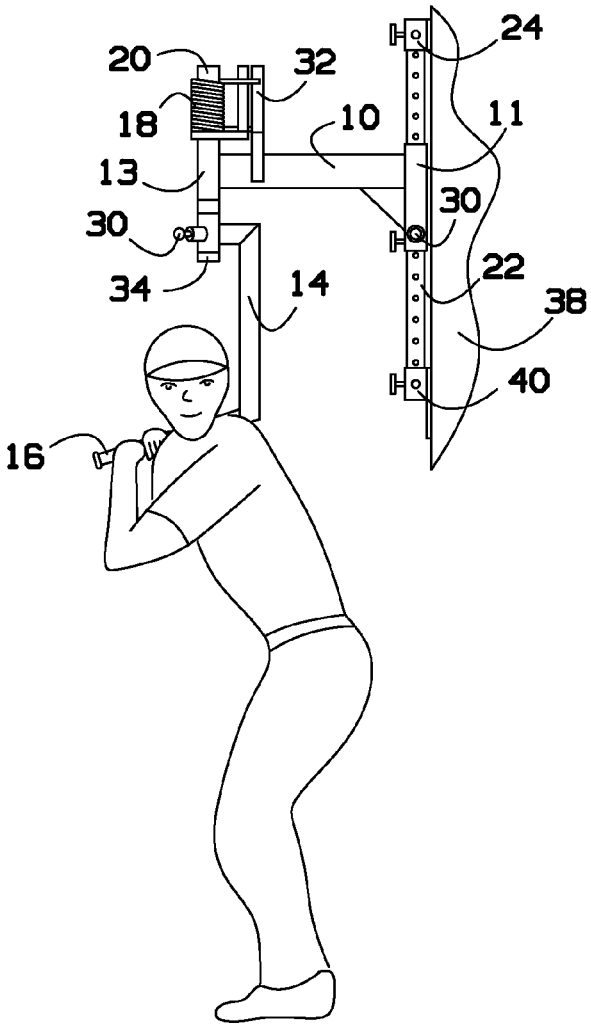
FIG. 1 illustrates a front view of a batting training machine in use in accordance with an exemplary embodiment of the present invention
Figure 2:
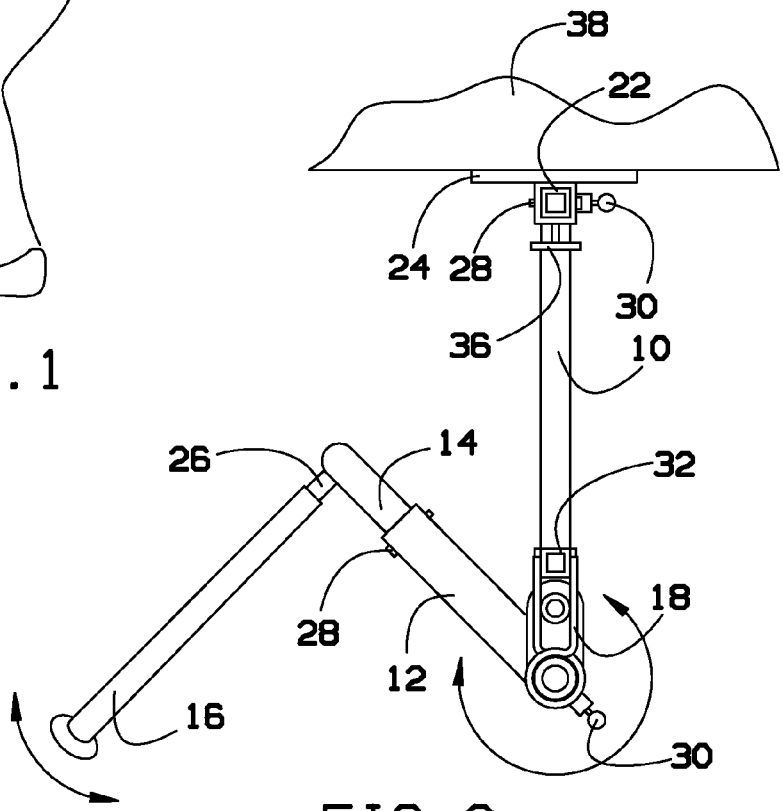
FIG. 2 illustrates a top view of a batting training machine in accordance with an exemplary embodiment of the present invention.
Figure 3:
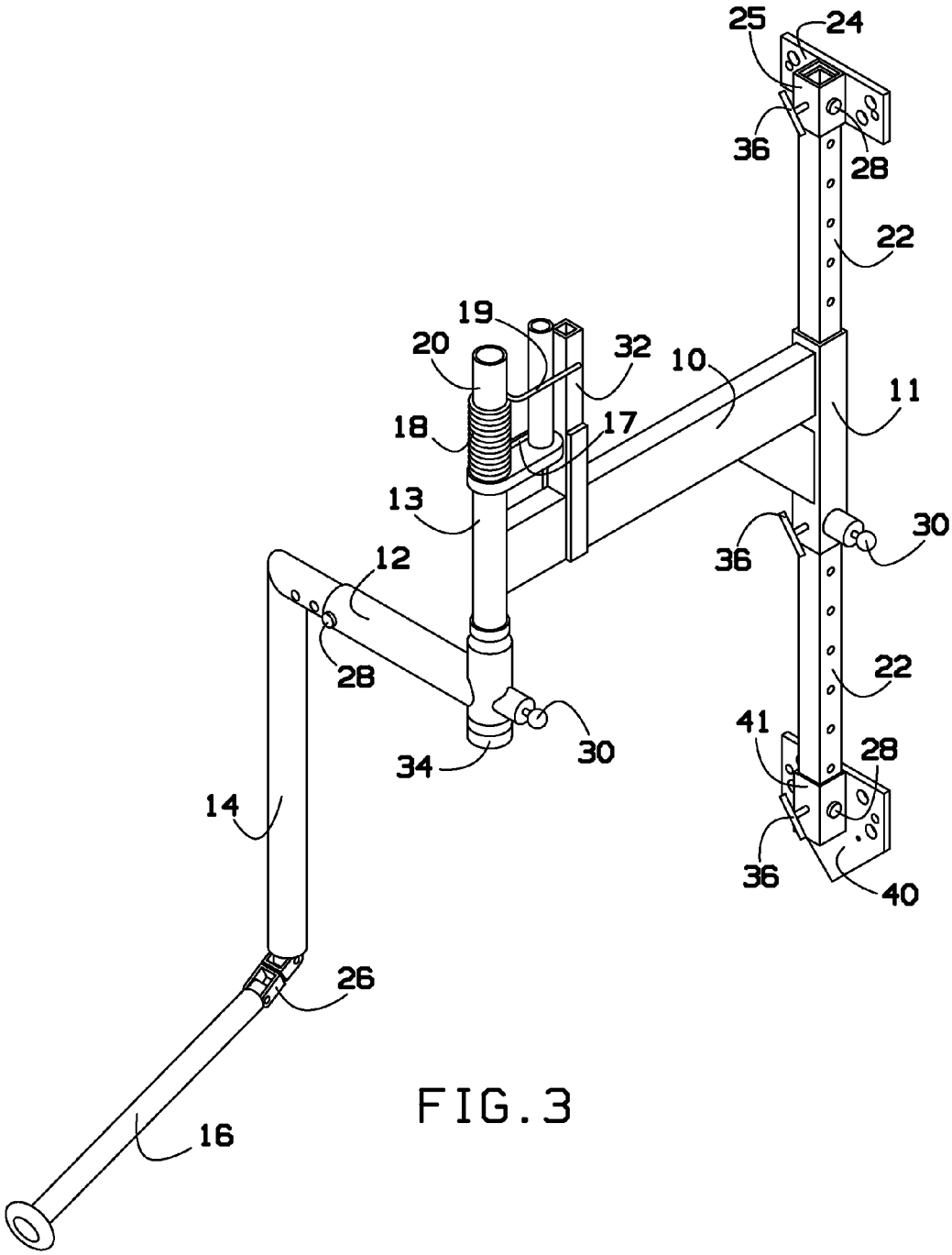
FIG. 3 illustrates a perspective view of a batting training machine in accordance an exemplary embodiment of the present invention.
Figure 4:
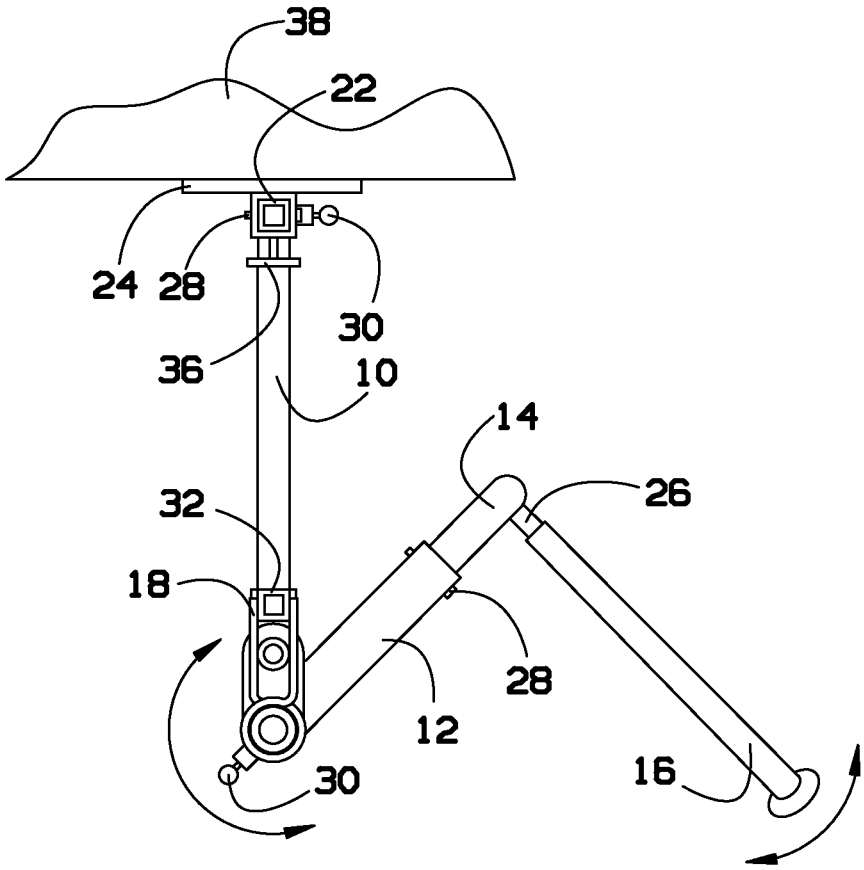
FIG. 4 illustrates is a top view of a batting training machine in accordance with an exemplary embodiment of the present invention in left handed hitter position.

Referring to FIGS. 2-4 of the drawings, an exemplary embodiment of the present invention includes: a frame 10 which is attached to an adjustment post 22 with a spring plunger pin 30 to allow for height adjustment and a t-screw 36 to provide rigidity when lightened. The adjustment post 22 is carried by two wall/post mount brackets 24 and 40 with two quick release pins 28 for easy installation and removal and two t-screws 36 to provide rigidity when tightened.

Spring mounting post 20 is carried by frame 10 at head tube 13 utilizing bearings or bushings for smooth rotation and supports torsion spring 18 to provide tension when spring mounting post 20 is rotated and the opposing leg of torsion spring 18 is retained in position by spring stop 32. Coupling arm 12 is fastened to spring mounting post 20 with a spring plunger pin 30 and retained from disassembly by a coupling cap 34. The position of coupling arm 12 on spring mounting post 20 can be adjusted angularly around spring mounting post 20 by pulling spring plunger pin 30 to increase or decrease preload tension or to swing coupling arm 12 between in right and left hand positions as illustrated in FIGS. 2 and 4, respectively.

Swing arm 14 is carried by coupling arm 12 and retained in telescoping fashion with a quick release pin 28. Swing arm 14 has multiple hole locations for adjustment in coupling arm 12 which can increase or decrease the radius of the swing. Bat handle 16 is pivotally connected by a three way swivel 26 and attached to swing arm 14. Three way swivel 26 allows for free movement of the lower, distal end of bat handle 16 while constraining the upper, proximal end in a horizontal plane.

To install, mounting brackets 24 and 40 may be secured to a rigid post or wall. Then, adjustment post 22 is fitted through slide 41 of bottom mounting bracket 40, slide 11 of frame 10 and continuing through slide 25 of top mounting bracket 24. The adjustment post 22 may then be held in place with two quick release pins 28 through mounting bracket slides 24 and 40. Then two t-screws 36 located on mounting brackets 25 and 41 may be tightened for added stability.

After securely mounting the batting training machine, the training machine may be used by an athlete, trainee or any other user. Vertical positioning of frame 10 may be adjusted according to the height of the user by pulling spring plunger pin 30 on frame 10 and locating it in the desired position on adjustment post 22 and tightening t-screw 36.

According to a preferred method of using the present invention, the appropriate height would be set with three way swivel 26 just below shoulder height of a user standing upright. The machine may be further prepared for use by pulling spring plunger pin 30 on coupling arm 12 to locate the angular position to accommodate right or left handed swings, as needed, or to establish the desired level of resistance. Next, swing arm 14 may be adjusted in a more extended or more retracted position within coupling arm 12 and secured with quick release pin 28.

The user then will stand under the axis point of the batting training machine with his or her back facing adjustment post 22, grip bat handle 16 and assume his or her normal batting stance. As the user repeatedly swings bat handle 16 as he or she would when at bat, he or she will rotate his or her hips and upper body to forcibly overcome the resistive torque produced by torsion spring 18 and spring aim engagement with spring stop 32. After each swing bat handle 16, swing arm 14, coupling arm 12 and spring mounting post 20 will return to the original swing start position without the effort of the user.

Though there are many variations of training, this device will help the user to focus specifically on certain aspects of his or her swing. He or she may choose to concentrate on the beginning of the swing by driving with the back foot during the hip rotation. He or she may choose to practice hitting to the opposite field (i.e. pushing the bat handle 16 outward at the end of the swing). Alternatively, he or she may choose to practice pulling the ball by pulling the device around 180 degrees or more.

While disclosed as being for use to train an athletes bat swing, the present invention may also find application to tennis to train performing forehand or backhand swings. This can be accomplished while holding the handle with one or both hands. It may also be used by others for any sport or activity having a similar swing motion.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. A bat swing training machine, comprising:

a frame including a head tube, a spring stop and a frame slide;

a vertical spring mounting post rotatably received in the head tube;

a coupling arm rotatably connected to the spring mounting post;

a swing arm having a lower portion and an upper portion formed at an angle to the lower portion, the upper portion being slidably received within the coupling arm;

a handle connected by a universal swivel to the swing arm lower portion wherein the universal swivel connecting the handle to the swing arm lower portion is a three way swivel; and a vertical torsion spring having upper and lower spring legs engaged to the vertical spring mounting post such that one spring leg rotates with the spring mounting post in at least one direction while the other spring leg pressures the spring stop.

2. The bat swing training machine as set forth in claim 1, further comprising:

upper and lower mounting brackets each having slides.

3. The bat swing training machine as set forth in claim 2, further comprising:

a plurality of quick release pins.

4. The bat swing training machine as set forth in claim 3, wherein:

the upper portion of the swing arm is securable within the coupling arm at a variety of depths by one or more of the plurality of quick release pins.

5. The bat swing training machine as set forth in claim 3, further comprising:

an adjustment post slidably received within upper and lower mounting bracket slides and having a number of pin holes formed therein for securing the adjustment post to the mounting bracket slides by one or more of the plurality of quick release pins.

6. The bat swing training machine as set forth in claim 5, further comprising:

a plurality of t-screws for stabilizing the adjustment post relative to the mounting bracket slides and stabilizing the frame slide relative to the adjustment post.

7. The bat swing training machine as set forth in claim 6, further comprising:

a plurality of spring plunger pins.

8. The bat swing training machine as set forth in claim 7, wherein:

the frame is slidably mounted on the adjustment post and locatable at a variety of positions along the post by one or more of the plurality of spring plunger pins.

9. The bat swing training machine as set forth in claim 8, wherein:

the coupling arm is rotatably secured to the spring mounting post at an angle by an end cap and is positionable at a variety of degrees of rotation relative to the spring mounting post by one or more of said spring plunger pins.

10. A batter training apparatus, comprising:

upper and lower mounting brackets each having slides;

a plurality of quick release pins;

an adjustment post slidably received within the upper and lower mounting bracket slides and having a number of pin holes formed therein for securing the adjustment post to the mounting bracket slides by one or more of the plurality of quick release pins;

a plurality of spring plunger pins;

a frame including a head tube, a spring stop and a frame slide slidably mounted on the adjustment post and locatable at a variety of positions along the post by one or more of the plurality of spring plunger pins;

a vertical spring mounting post rotatably received in head tube;

a coupling arm rotatably connected to the spring mounting post at an angle by an end cap and positionable at a variety of degrees of rotation relative to the vertical spring mounting post by one or more of said spring plunger pins;

a swing arm having a lower portion and an upper portion formed at an angle to the lower portion, the upper portion being slidably received within the coupling arm and securable therein at a variety of depths by one or more of the plurality of quick release pins;

a handle connected by a universal swivel to the swing arm lower portion wherein the universal swivel connecting the handle to the swing arm lower portion is a three way swivel;

a vertically mounted torsion spring having upper and lower spring legs engaged to the vertical spring mounting post such that one spring leg rotates with the spring mounting post in at least one direction while the other spring leg pressures the spring stop; and a plurality of t-screws for stabilizing the adjustment post relative to the mounting bracket slides and stabilizing the frame slide relative to the adjustment post.

* * * * *